US005228861A

United States Patent [19]

Grabbe

[11] Patent Number: 5,228,861

[45] Date of Patent: Jul. 20, 1993

[54] HIGH DENSITY ELECTRICAL CONNECTOR SYSTEM

[75] Inventor: Dimitry G. Grabbe, Middletown, Pa.

[73] Assignee: AMP Incorporated, Harrisburg, Pa.

[21] Appl. No.: 897,686

[22] Filed: Jun. 12, 1992

[51] Int. Cl.[5] ..... H01R 9/09

[52] U.S. Cl. ..... 439/66; 439/591

[58] Field of Search ..... 439/66, 71, 74, 91, 439/591

[56] References Cited

U.S. PATENT DOCUMENTS 5,015,191 9/1992 Grabbe et al. ..... 439/71
5,061,192 9/1992 Chapin et al. ..... 439/66
5,139,427 8/1992 Boyd et al. ..... 439/66

*Primary Examiner*—Neil Abrams
*Attorney, Agent, or Firm*—Bruce J. Wolstoncroft; Driscoll A. Ninh, Jr.

[57] ABSTRACT

An electrical connector (10) for interconnecting a component (50) and a circuit (58) having pads (54, 60) on closely spaced centers for high density packaging includes a thin, dielectric member (12) carrying contacts (20) on centers compatible with the centers of the component and circuit pads; the contacts having spring arms (28, 32, 36, 40) extending from a central mounting portion (22) in a star-like configuration to provide an outward wiping engagement with component and contact pads as the contact is compressed by displacement of the component toward the circuit. The contact arms are of a geometry and have characteristics to provide a balanced force precluding rotary or twisting loads on the dielectric member and are tapered to further provide a desired deflection and sufficient normal force to define a stable, low-resistance electrical interface. The component and circuit pads, (54, 60) have lengths appropriate to the length of contact arms to provide an optimum spring deflection and wiping of pad surfaces and a width less than the length to provide closer center-to-center spacings between the pads. The pads of the component are oriented lengthwise transversely to the pads of the circuit to further facilitate close spacing and the pads of both component and circuit are preferably tapered to facilitate close spacing with the ends available for connecting to traces (62) on the same or common surface of a board for enhancing density of packaging.

35 Claims, 7 Drawing Sheets

HIGH DENSITY ELECTRICAL CONNECTOR SYSTEM

This invention relates to a high density electrical connector system that includes particularly shaped contacts in a multi-contact connector and particularly shaped conductive pads for components and circuits interconnected by such connector.

BACKGROUND OF THE INVENTION

Demand for higher speeds of computation dictates a higher density in packages of electronic components, interconnecting circuits, connectors and contacts therefor. This is caused directly by the detrimental effects on signals due to electronic parameters, capacitance, inductance, resistance, and the resulting impedances that cause delays and distortions of pulse forms, increasing the opportunity for error and sensitivity to noise in signal transmission and reception. By making elements smaller and more closely spaced, signal paths can be reduced to reduce the effects of such parameters on signals.

For this reason, center to center spacings in electronic packaging, including components and circuits, have been driven from 0.100 inches to 0.050 inches and now to less than that with pressure for 0.040 inch centers or even less. Continuing development in photolithography as a manufacturing method has allowed substantial reduction of components and circuits in terms of spacings, much more readily than that of adjunct packaging elements such as connectors or contacts that have been typically manufactured by stamping and forming of sheet metal. This is in part caused by the need to have connectors and contacts accommodate for tolerance variations in components and circuit boards through contact spring deflection and contact wipe. The need for closer centerspacing thus conflicts with the need for length in spring beam to facilitate deflection and wipe. The need for spring beam length conflicts with minimizing electrical parameters, particularly that of capacitance. Thus, a real problem exists in compromising the reality of manufacturing connectors and contacts, systems for interconnecting components and circuits, and the need for higher speeds of computation, higher speed pulses with shorter rise times and shorter duration.

Accordingly, it is an object of the present invention to provide a high density electrical connector system of improved transmission characteristics featuring a novel connector, contacts, and contact pads for components and circuits. It is a further object to provide a connector having contacts on very close center-to-center spacings with substantial deflection and contact wipe to assure practical manufacturing, assembly and functional tolerances for the interconnection of components and circuits. It is still a further object to provide an improved interconnection for planar devices such as land grid arrays and circuits therefor, as well as bare integrated circuits chips themselves.

SUMMARY OF THE INVENTION

The present invention achieves the foregoing objects through the provision of a system that includes a connector and contacts, along with a disposition of pads on components and circuits that optimize packaging density while assuring contact deflection and wipe to interconnect component pads to circuit pads. The invention connector includes a thin, flexible dielectric member having upper and lower planar surfaces with mounting means in the form of either holes in one embodiment or projections in another embodiment on centers compatible with the centers of the pads to be interconnected of components and circuits. Additionally, a plurality of holes adjacent the mounting means are provided in the dielectric member with a contact positioned by the mounting means, including a center portion cooperatively engaging the mounting means and at least two upper resilient contact arms having contact tips extending through the holes above the dielectric member, the upper surface thereof, to contact a component pad. The contact further includes at least two further resilient contact arms having contact tips extending downwardly from the center portion of the contact to engage contact pads of a circuit. The contact of the invention is generally star shaped, with the upper and lower resilient contact arms extending radially outward from the center portion of the contact, and each of the arms, in a preferred embodiment, having a tapered geometry and having material characteristics formed by the material of which the contact is stamped to be displaced through the compression of the contact pads of component in circuit driven towards each other. The upper and lower contact arms are designed to provide balanced, or equal, upper and lower forces to preclude twisting or turning loads on the dielectric member, allowing such member to be thin and flexible to provide an improvement of height compared with certain other types of connector contacts. Upon closure of component and circuit, the contacts are deflected so that the ends are displaced under increasing normal forces to wipe the pads and provide a low resistance, stable electrical interface, the wipe assuring the removal of debris from such surfaces. In one embodiment, the contact includes a central boss that frictionally fits within a central hole in the dielectric member to hold the contact in position relative thereto. In another embodiment, the contact includes a hole through which a projection formed in the dielectric member extends and is locked to the contact through mechanical or thermal deformation. In still another embodiment, the contact is given tabs in the central portion thereof that extend through the mounting holes in the dielectric member and are deformed to lock the contact to the mounting member. In still another embodiment, the contact is given a central hole through which a rivet is applied, locking the contact to the dielectric member.

In one alternative embodiment, the contact is stamped and formed of thin, conductive noble metal stock to provide utility in use with precious metal plated pads of component and circuit.

IN THE DRAWINGS

DETAILED DESCRIPTION OF THE INVENTION

With respect to the description of the invention to follow, it is to be understood that the invention interconnection system embraces the provision of an electrical interconnection between components and circuits such as land grid array integrated circuit components and printed circuits adapted to accommodate numbers of such components, the interconnection of which provides circuit functions for computers and the like. The invention features a connector that fits between the planar contact pads of a component and the planar contact pads of circuits, held therein by a connector housing. Such housings are widely known, and reference is made to U.S. Pat. No. 4,927,369 granted May 1990; U.S. Pat. No. 4,957,800 granted September 1990; and U.S. Pat. No. 4,969,826 granted November 1990, which disclosures are incorporated herein by reference for examples of housings for carriers adapted to accommodate chip carriers and land grid array components for interconnection to plastic or ceramic components and/or boards. In use, the connector to be described is placed within the housing with the circuit component placed on top of such connector and a top portion of the housing closed against the component to drive such component toward the connector and in turn compress the contacts of the connector against contact pads of a circuit upon which the housing and component are mounted.

Figure 1:
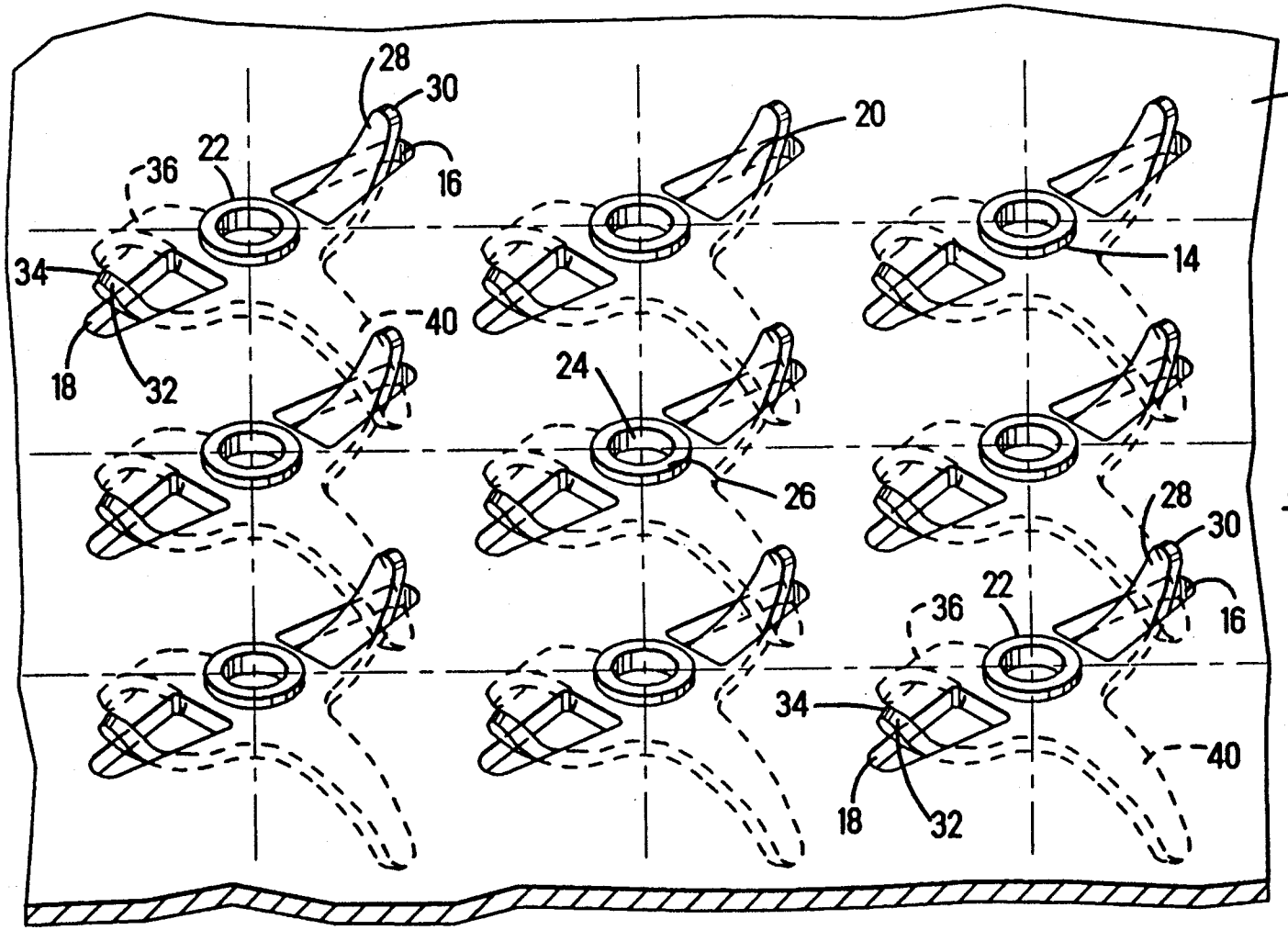
FIG. 1 is a perspective, considerably enlarged from actual size, of the connector in accordance with the invention showing a dielectric member containing a plurality of contacts.
Figure 2:
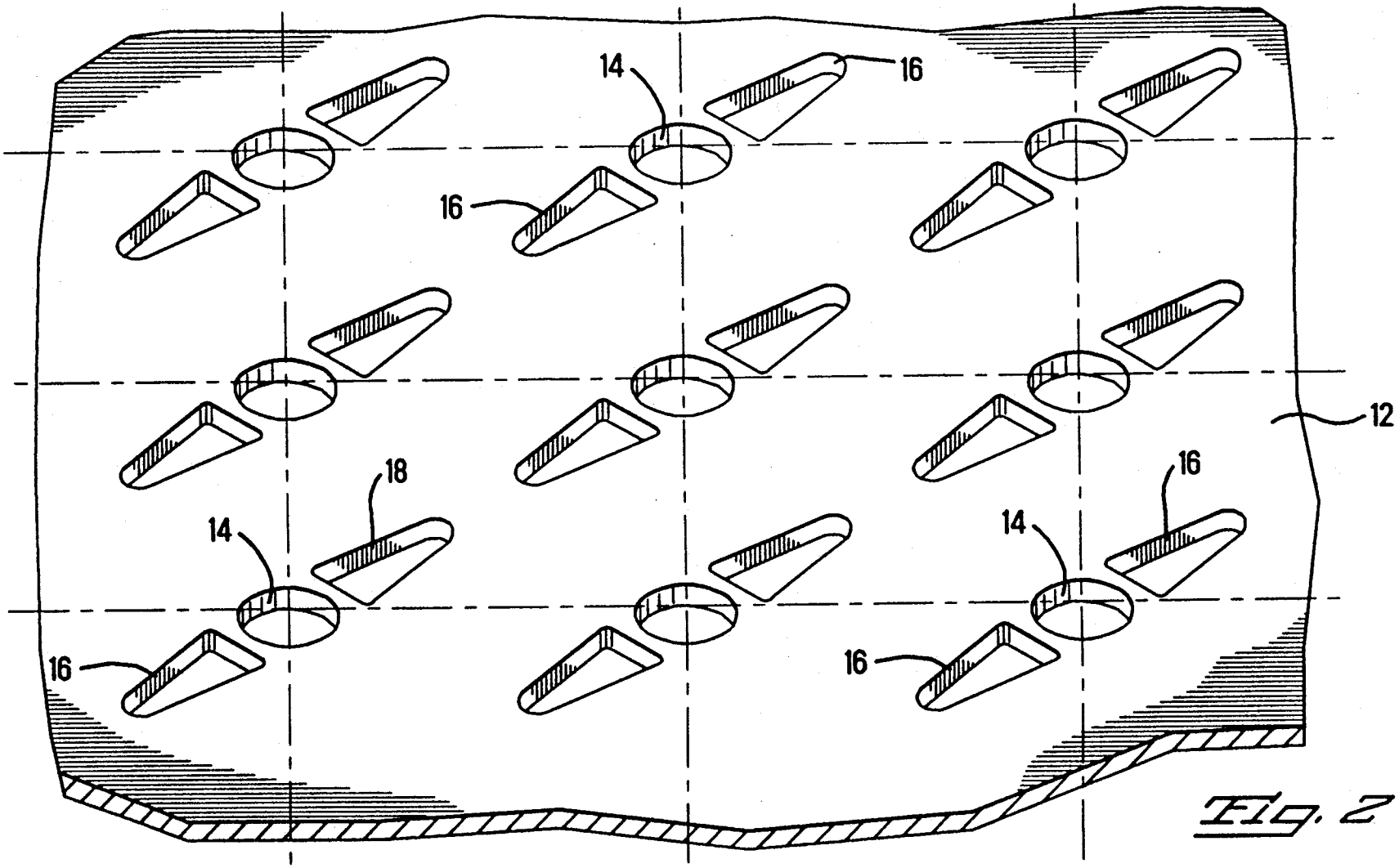
FIG. 2 is a perspective showing the dielectric member of the connector of the invention without contacts.
Figure 3:
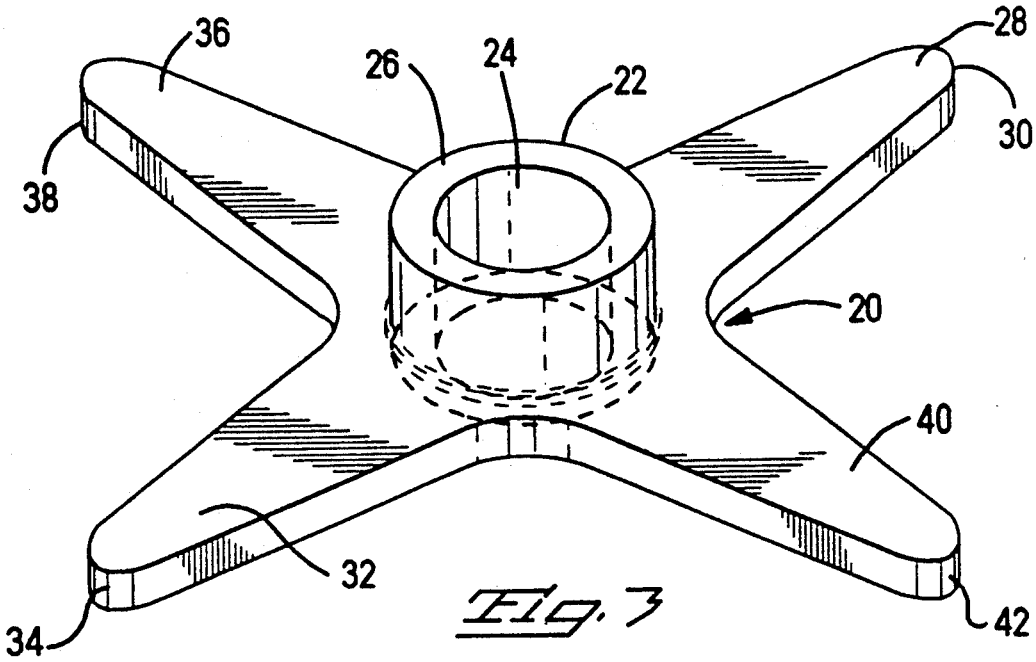
FIG. 3 is a perspective showing the contact of the invention, partially formed.
Figure 4:
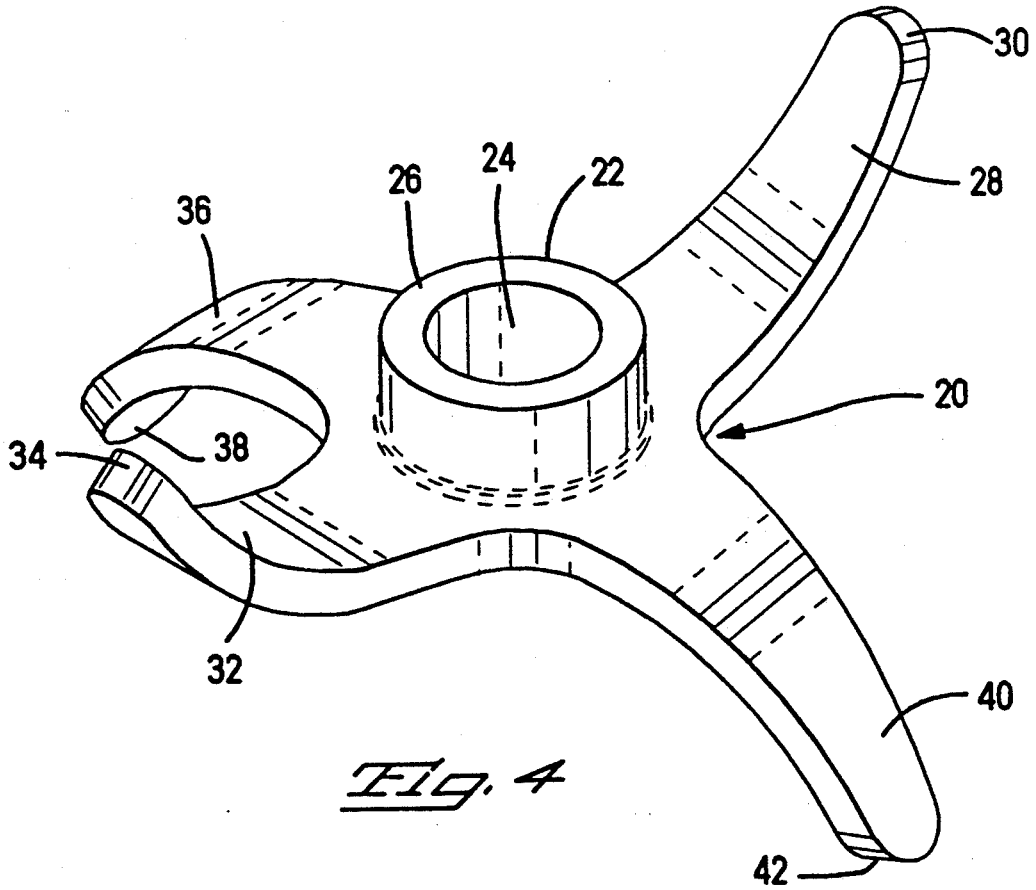
FIG. 4 is a perspective showing the contact of FIG. 3 fully formed.

Referring now to FIG. 1, the invention connector 10, shown much enlarged from actual size, includes a thin, flexible and dielectric member 12 that, in various embodiments, may be formed, for example, from a film or sheet material such as Kapton, Mylar, or various other forms of dielectric materials by stamping or by other methods of profiling such as laser oblation or etching. In one embodiment, the member 12 is stamped and formed to include sets of holes shown in FIG. 2 to include a center hole 14 bordered by holes 16 and 18, arranged on centers corresponding to the centers of contact pads of a component and contact pads of a circuit. These centers are shown through the grids depicted in FIGS. 1 and 2, it being understood that such grid is shown obliquely or in perspective and would ordinarily be square in nature. As can be seen in FIG. 1, contacts 20 include a central mounting portion 22 of a diameter to frictionally fit within hole 14 in member 12. The central portion 22 includes a central hole or bore 24 and a wall thickness 26 with a plurality of contact arms 28, 32, 36, and 40 extending radially outwardly from the central portion 22. FIG. 3 shows the contact 20 in a partial state of formation, the contact preferably stamped and formed from a flat, spring grade conductive material such as high palladium content alloys or the harder forms of phosphor bronze or from beryllium copper with the arms profiled as shown in FIG. 3 and with the center portion 22 effectively drawn by such stamping and forming in a well-known manner. FIG. 4 shows the contact 20 in a final configuration with the arms 28 and 32 formed upwardly and the arms 36 and 40 formed downwardly. As can be seen in FIGS. 3 and 4, and also in FIG. 1, each of the contact arms has a contact tip ending in an edge surface. These include surface 30 with respect to arm 28, surface 34 with respect to arm 32, surface 38 with respect to arm 36 and surface 42 with respect to arm 40. The contact tips including surfaces 30 and 34 extend upwardly to engage a pad of a component and the contact tips carrying surfaces 38 and 42 extend downwardly to engage the contact pad of a circuit. As can be seen in FIG. I, contacts 20 are so positioned within member 12 that contact arms 28 and 32 extend up through the holes 16 and 18, above the upper surface of member 12 and the contact arms 36 and 40 extend downwardly beneath the lower surface of such member.

Figure 5:
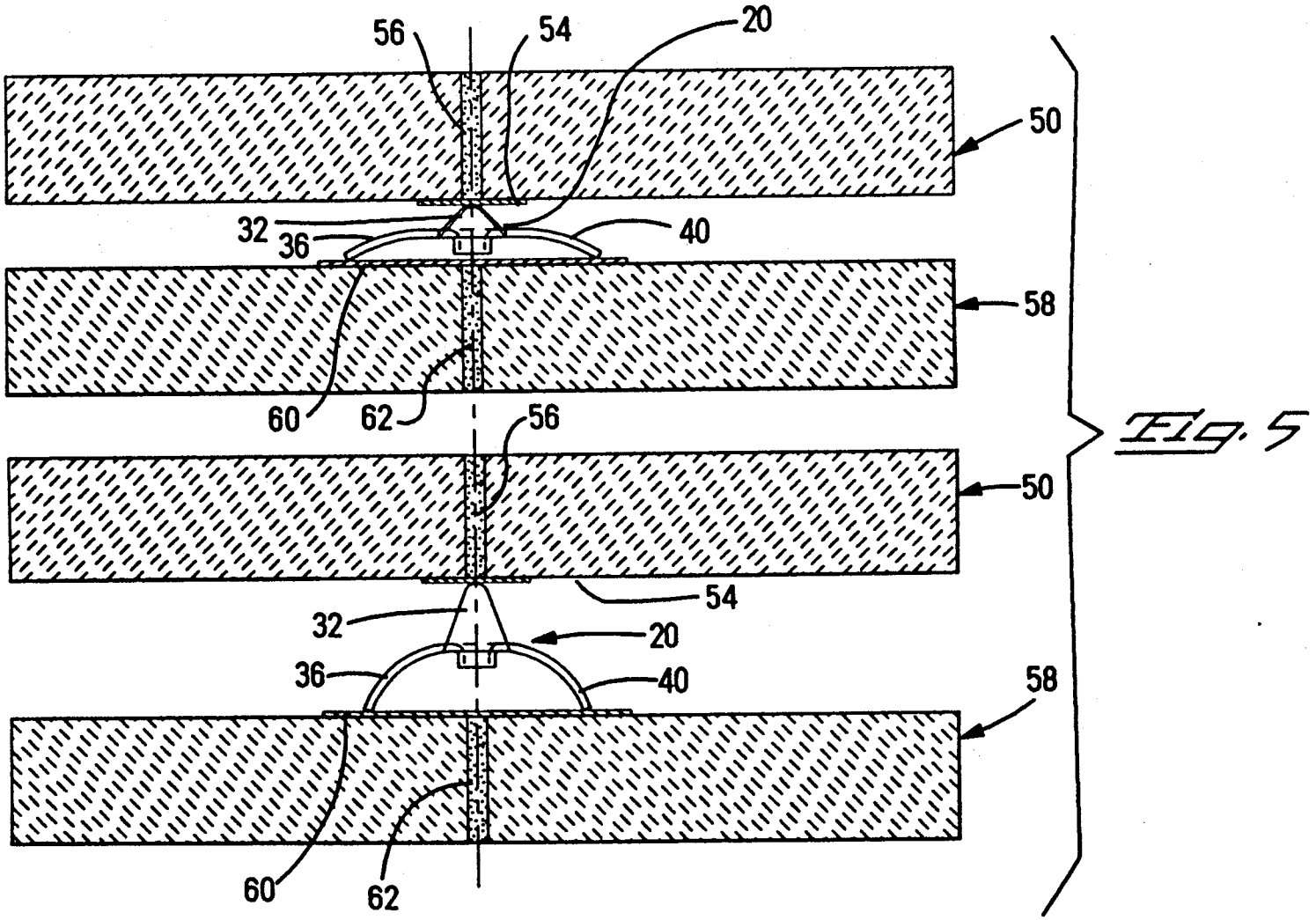
FIG. 5 is a side view, partially sectioned, of the contact of the invention in relation to component and circuit pads in an open and closed condition.

FIG. 5 shows the contacts 20 in an uncompressed initial condition in the lower portion of the Figure and in a compressed position in the upper portion thereof, member 12 not being shown in FIG. 5. In FIG. 5, a portion of a component 50 is shown to include a planar contact pad 54 on the under surface of the component, interconnected to a conductive via 56 that extends transversely to the lower face of the component. It is to be understood that a component such as 50 might include hundreds of pads 50 with the vias 56 interconnecting to layers within the package 50 in turn connected to memory and logic devices interconnected to form the function of the component. Positioned beneath component 50 is a circuit 58 that may be part of a circuit board or structure having an upper planar surface including a contact pad 60 interconnected by a via 62 in turn interconnected to traces within the body of the component that lead to other components to effectively interconnect component 50 to such other components. Again, it is to be understood that the circuit 58 could contain hundreds or thousands of contact pads 60 in arrays distributed over the upper surface.

To be appreciated is the fact that the lateral forces due to the friction of wiping of contacts are cancelled since these forces are directly opposed parallel to the plane of devices 50 at 58; the net lateral force on a contact W is zero. With the possibility of thousands of contacts 20 driven as in FIG. 5 this becomes an important advantage.

Figure 9:
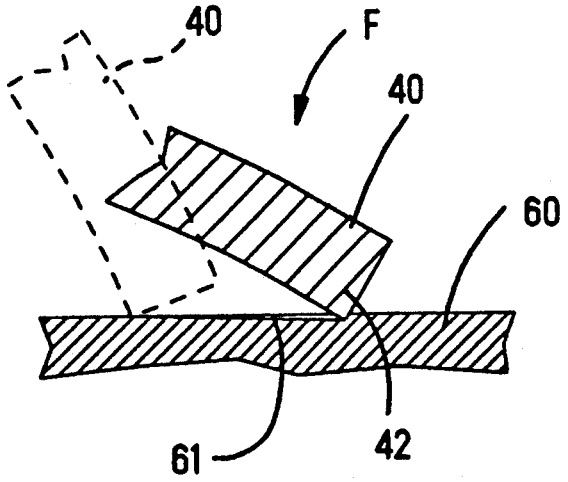
FIG. 9 is a side, elevational, and sectional view showing the engagement of a contact tip with a contact pad and the wipe achieved by interconnection of the contact with the pad.

The contact pads 54 and 60 are typically formed through photolithography by either etching or additive processes utilizing various forms of copper overplated with nickel and precious metals such as gold or alloys thereof suitable for electrodeposit and/or electroless deposit as well as by stencil printing or deposition of conductive material, which may be sintered or fired as for example on ceramic substrates. As can be seen in FIG. 5, the contacts 20 are positioned to be aligned so that the contact tips engage the outside edges of the contact pads, tips 38 and 42 engaging the pads 60 and tips 30 and 34 engaging the pads 54. As can also be seen in FIG. 5, the closure of component 50 against circuit 58 as by the closure of a housing, such as the housings referred to in the aforementioned patents, will result in a compression of contact 20 through a deflection of the contact arms, noting the displacement of the contacts from the position in the lower portion of FIG. 5 to the position shown in the upper closed portion of FIG. 5. Note also that the contact tips are displaced outwardly to effect a wipe of the pads by the contact tips. FIG. 9 shows the contact tip 42 of contact arm 40 in an initial position, the position shown in the lower portion of FIG. 5, in phantom in FIG. 9, and solidly shown in the upper position. To be noted the contact tip is displaced outwardly, creating in the surface of pad 60 a slight indentation as shown as 61 in the surface of pad 60 that represents a polishing or burnishing due to the normal force F driving the contact tip down against such surface, and the edge of surface 42 wiping along under the normal force over the surface. This wiping action has been demonstrated repeatedly to provide a superior electrical interface, wiping films and oxidation products, debris, insulation and dust particles and smearing over microscopic plating holes to assure a low resistance, stable electrical interface between contact and pad.

Figure 6:
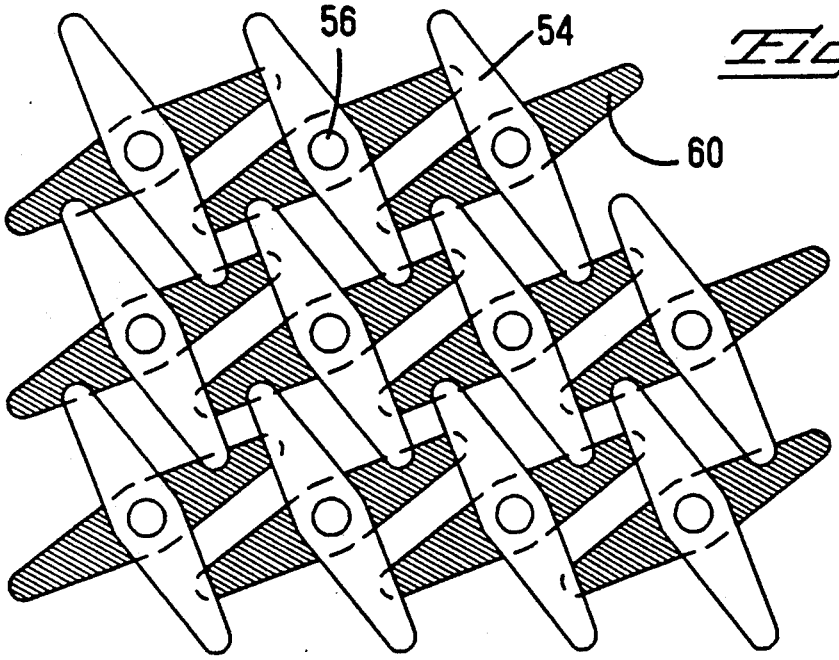
FIG. 6 is a plan view depicting the arrangement and geometries of contact pads of component and circuit in accordance with one embodiment of center-to-center pad spacing.
Figure 7:
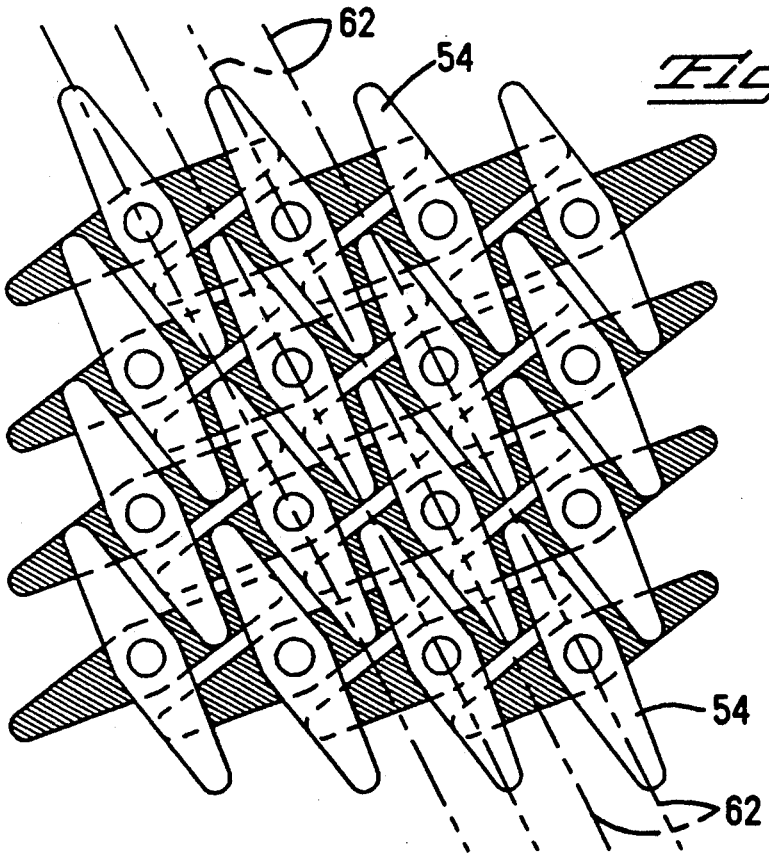
FIG. 7 is a view showing the arrangement and geometry of contact pads of an alternative embodiment of center-to-center pad spacing.
Figure 8:
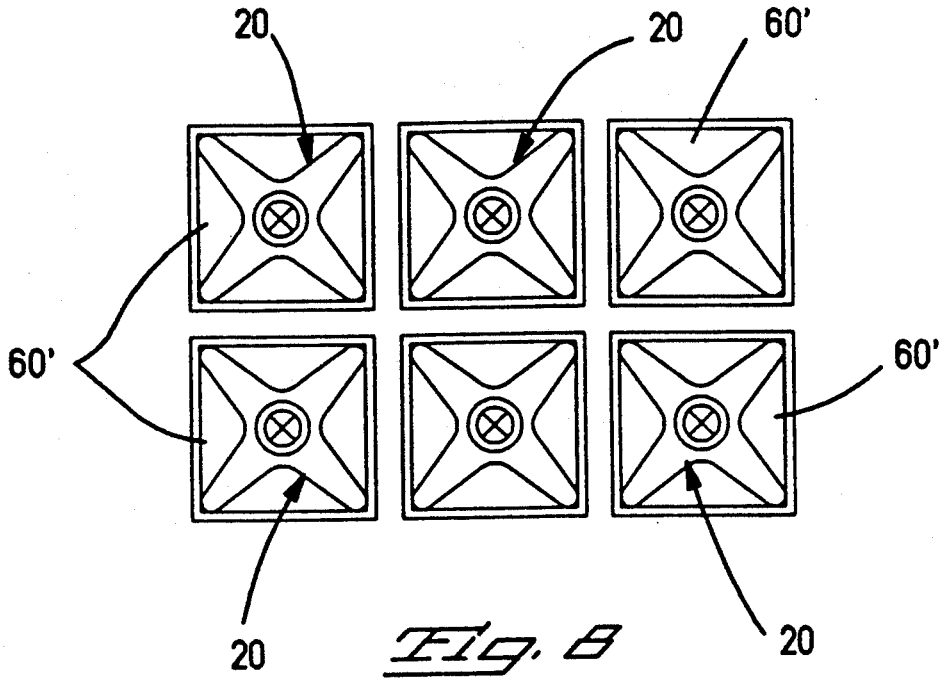
FIG. 8 is a plan view showing contacts in relation to contact pads of yet a further geometry and spacing.

A suitable deflection of the contact spring to achieve an appropriate normal force F as shown in FIG. 9 and an appropriate wiping of the contact surfaces is necessary for a good interconnection. It is also advisable to accommodate for manufacturing tolerances of contacts, components, circuits, and the contact pads such that, in all events, an adequate force and an adequate wipe is achieved despite slight variations in spacing of pads between components and circuits. FIG. 8 shows contacts 20 centered on pads 60' of a conventional square or rectangular geometry. The representation shown in FIG. 8 is of a version of the invention contact having a tip-to-tip dimension on the order of slightly more than 0.053 inches with the contact pad having a dimension of 0.040×0.040 inches arranged on 1.2 mm grid. As can be appreciated, with respect to FIG. 8, there is very little room, essentially an insufficient spacing, between the pads 60' to allow for surface traces in between such pads. The invention contemplates a use of the connector of the invention with respect to rectangularly shaped pads like that shown in FIG. 8 because many systems exist having such pads. The invention also contemplates, in a preferred embodiment, an arrangement of pad geometry and spacing as shown in FIG. 6. There, as can be discerned, the pads 54 and 60 have a length considerably greater than the width extending out from the vias 56 and 62 toward the center of the pads. Moreover, the pads taper outwardly from the vias and have a length determined by the needs of the contact with respect to deflection and wipe with the width of the pads suitably reduced to allow an improvement in center-to-center spacing. Comparing the arrangement of FIG. 6 to the arrangement of FIG. 8 shows the increased room between pads resulting from the pad geometry shown in FIG. 6 as compared to the pad geometry shown in FIG. 8. The shape of the pads 54 and 60, in addition to reducing the plated areas and achieving the potential of increased density, contemplates the provision of a tapering area sufficient to generally maintain the low current density through the pads and as well an area sufficient to accommodate the tolerances of contacts 20 and the positioned thereof by member 12. FIG. 7 shows pads 54 and 60 arranged on a 1 mm grid, achieving a very substantial increase in density with the same pad geometry and area. As is also shown in FIG. 7, it is possible to provide contact traces 62 to at least four rows of pads on the same surface, not possible with the pad configuration shown in FIG. 8 if expanded to four rows.

To also be appreciated is the length of contact current path with respect to a use of the present invention, such length being between the tips of adjacent contact arms, such as between contact arm 28 and 40 rather than through the star shape of the contact diagonally.

In one version of the invention, the pads 54 and 60 were made to have an overall length on the order of 0.0837 inches to be used on 0.040 centers. These pads have a maximum width of 0.0196 inches. Such pads were used with a contact 20 having contact arms of a length tip-to-tip in the flat condition of 0.0837 inches, the ends being given a radius of 0.0040 inches from centers spaced apart 0.0757 inches. The taper for such contacts, as measured from a line drawn through the center of the contact and the contact arms, was at an angle of 8.858 degrees. This taper provides a uniform stress level throughout the length of the contact arm, a desired feature that can be achieved by other geometrics. Smaller versions of contacts, including an overall dimension of 0.0537 inches, were also utilized for higher densities with an appropriate reduction in pad size. To be noted is the flexibility of the pad geometry shown in FIGS. 6 and 7 with respect to use on 1 or 1.2 mm grids.

In one embodiment of the invention, the thickness of the contact was on the order of 0.018 inches for a material having characteristics similar to that of beryllium copper, or the material PALINEY 7 or PALINEY 6 (TM) from J. M. Ney Co. of Bloomfield, Connecticut, 06062. In the contact version having an overall dimension of 0.0837 inches, the contact arms were formed to have a relaxed dimension from contact tip to contact tip in a vertical sense, such as shown in the lower portion of FIG. 5, on the order of 0.0412 inches with a closed, compressed dimension on the order of 0.0173 inches, as is shown in the upper portion of FIG. 5. This resulted in a contact wipe on the order of 0.007 inches for each contact tip. Contact wipes ranging between a little over 0.001 to as much as 0.010 inches have been utilized effectively. Contact normal forces ranging between 25 and 100 grams have been utilized to provide reliable, long-term, low-resistance interconnections when used with precious metal such as gold or alloys thereof. Contacts like those described are capable of accommodating substantial current levels, up to 2 amperes, for example.

Figure 10:
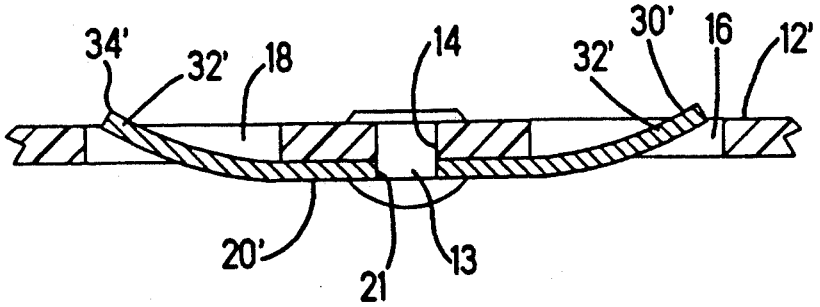
FIG. 10 is a side, sectional, and elevational view of a contact and dielectric member in an alternative embodiment.
Figure 11:
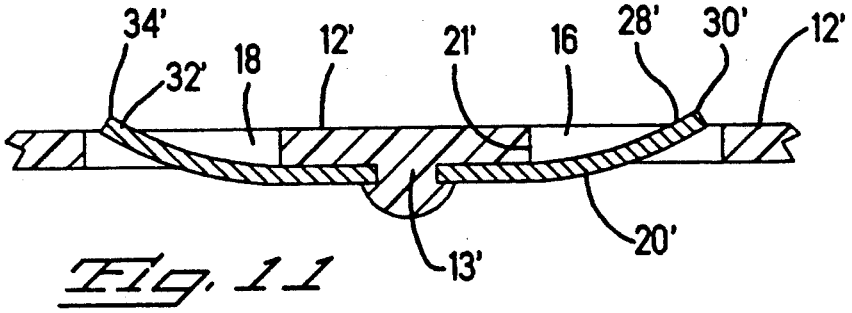
FIG. 11 is a side, sectional, and elevational view of the contact and dielectric member of the invention in another alternative embodiment.

FIG. 10 shows an alternative embodiment of the invention wherein the dielectric member 12 includes an aperture 14 through which a rivet 13 is fitted, such rivet extending through a hole 21 in a contact 20'. Corresponding prime numbers shown in FIG. 10 reflect the numbers detail with respect to the embodiments previously shown. It is contemplated that the rivet 13 may be made of plastic or metal, suitably deformed axially to form a head locking the contact 20' to member 12. A further alternative is shown in FIG. 11 with respect to a dielectric member 12' that is molded to include the apertures 16 and 18 and in lieu of the central aperture 14, a projection 13' is provided that is either mechanically deformed or thermally formed to lock the contact 20' to member 12', the contact having an aperture 21' therein. The remaining parts of contact 20' are as previously described, carrying prime numbers in the manner shown in FIG. 10.

Figure 12:
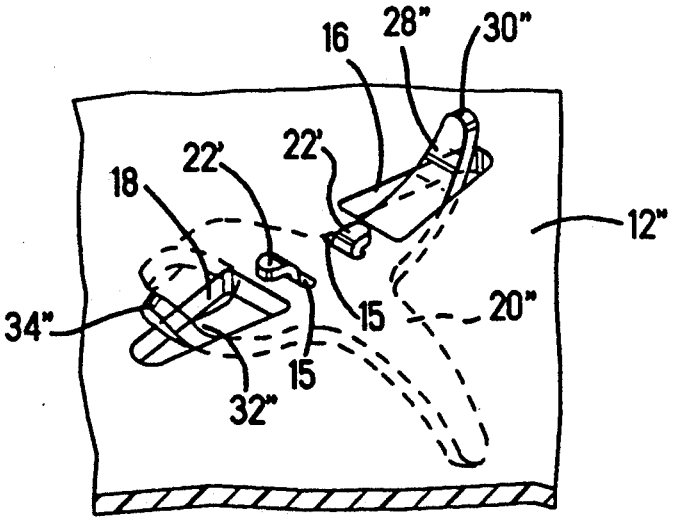
FIG. 12 is a perspective showing a contact and dielectric member of yet a further alternative embodiment.

FIG. 12 shows yet another embodiment wherein the contact 20" is shown in relationship to a dielectric member 12" having a series of outer holes 16 and 18 and further holes 15 through which are fitted tabs 22' formed from contact 20', the remaining commonly numbered elements being double-primed with respect to the showing in FIG. 12. The invention contemplates that the contact 20 may be formed in two pieces, each having a hole in the center with the two pieces carrying contact arms and assembled together to form a star shape.

The invention system, including connector, contacts, and pad geometries of component and circuit, is believed to balance the intrinsic conflict between the need for high density electronic packaging, the need to minimize the effects of capacitance, inductance, and resistance, and resulting impedances, with the need for a meaningful spring deflection and wipe of contact surfaces to achieve an improvement in packaging density which is meaningful and substantial.

Having now described the invention in relation to drawings in terms intended to set forth preferred embodiments, claims are appended, intended to define what is deemed inventive.

I claim:

1. An electrical connector for use in interconnecting the conductive pads of components to the conductive pads of circuits on close centers to provide high density packaging, including a thin dielectric member having upper and lower planar surfaces and a mounting means on centers compatible with the centers of the pads to be interconnected, the member having a plurality of holes adjacent said mounting means and a contact positioned by each mounting means including a center portion cooperatively engaging said mounting means, and at least two upper resilient contact arms having contact tips extending through the holes above the dielectric member upper surface to contact a component pad and at least two lower resilient contact arms having contact tips extending downwardly from said mounting means to a contact pad of the circuit with the upper and lower resilient contact arms extending radially outward from the center portion and including geometries and having material characteristics to be deflected by displacement of the component toward the circuit to develop essentially equal upper and lower normal contact forces between said contact tips and said pads with a wiping therebetween to provide a low resistance, stable electrical interface with minimum loading of the said dielectric member.

2. The connector of claim 1 wherein the contact has a generally star shaped plan profile.

3. The contact of claim 1 wherein the contact arms are tapered from the center toward the contact tips to provide an increasing force per unit of deflection of the arms.

4. The connector of claim 1 wherein the said contact arms are curved toward the pads engaged thereby to facilitate a deflection thereof tending to flatten the arms.

5. The connector of claim 1 wherein the said contacts are stamped and formed of spring grade conductive material stock.

6. The connector of claim 1 wherein the dielectric member is formed of plastic sheet material profiled to define said holes as by stamping, laser oblation, chemical etching or the like.

7. The connector of claim 1 wherein the contact tips include edges shaped to burnish the pad surfaces during wiping of the contacts by said edges.

8. The connector of claim 1 wherein the said contacts are formed of a noble metal alloy.

9. The connector of claim 1 wherein the said mounting means includes a hole, and the contact central portion includes at least one projection of a dimension to fit within said hole and retain the contact in position in said dielectric member.

10. The connector of claim 1 wherein the said mounting means is a projection and the contact center portion includes a hole through which the projection extends to hold the contact in position in the dielectric member.

11. The connector of claim wherein the said mounting means includes a hole and the contact includes a hole with a rivet extended through the said holes to lock the contact to the dielectric member.

12. The connector of claim 1 wherein the dielectric member includes multiple rows of mounting means and multiple rows of contacts.

13. The connector of claim 1 wherein the said sheet of plastic material is stamped profiled to define said holes and the said contact is stamped and formed to provide a mechanically derived connector.

14. The connector of claim wherein the said dielectric member is molded of a plastic material to include projections and the contact includes holes receiving said projections for mounting to said dielectric member.

15. An electrical contact for use in interconnecting the contact pads of a component to the contact pads of a circuit or the like wherein said pads are planar surfaces and the contact is disposed therebetween, the contact including a one-piece element of thin, conductive spring grade material formed to include a central portion having means to mount the contact on a mounting member and including radiating outwardly from the central portion at least four contact arms ending in contact tips adapted to engage the contact pads, the contact arms each being formed to extend in a sense transverse to the plane of the central portion to define a spring element deflected by displacement of the contact pads of the component toward the contact pads of the circuit with two of the contact arms oriented to engage the component contact pads and two of the contact arms oriented to engage the contact pads of the circuit and with the arms having force deflection characteristics to provide a force on said pads for each arm sufficient to produce a wiping action and a low-resistance, stable electrical interface with a balance of forces of the four arms precluding the center portion from being driven in twisting or rotary motion.

16. The contact of claim 15 wherein the plan profile is star shaped.

17. The contact of claim 15 wherein the said contact arms are tapered to provide a force deflection characteristic stiffening as the arm is deflected.

18. The contact of claim 15 wherein the contact is stamped and formed of said material into a geometry that is cup shaped in cross-section through a given pair of oppositely radiating arms.

19. The contact of claim 15 wherein the contact is of a noble metal alloy.

20. The contact of claim 15 including a hole in the central portion adapted to receive a projection to mount the said contact.

21. The contact of claim 15 wherein the center portion includes a projection adapted to engage a member mounting said contact.

22. The contact of claim 15 wherein the contact has a cross-sectional concave shape.

23. An electrical interconnection including a connector, component, and circuit having common planar surfaces containing high-density, closely spaced contacts, the component and circuit having contact pads each of a length greater than the width to facilitate the use of a contact having a spring beam adapted to be deflected to effect a wiping of the pad along the pad length with the pads of the component being oriented, with respect to the length thereof, generally at right angles relative to the length of the pads of the circuit to facilitate a close center-to-center spacing array of pads on component and circuit, the connector having a thin, dielectric, generally planar, member carrying discrete contacts extending between the component and circuit pads with each contact having at least two contact arms extending toward the pads of the component and oriented lengthwise parallel to the component pad length and two contact arms extending toward the pads of the circuit and oriented lengthwise parallel to the circuit pad length with the contact arms having tips adapted to engage the pads and the arms having spring characteristics to be deflected by displacement of the component toward the circuit to provide the wiping engagement of the pads and form a stable, low-resistance electrical interface.

24. The interconnection of claim 23 including rows of pads for the component and circuit each pad having a central portion of a given width and extending outwardly therefrom, tapering portions to facilitate a given center spacing for a given pad length with an internesting of pads on a common surface of adjacent rows or a component and circuit.

25. The interconnection of claim 23 wherein the said pads include, at least at the ends thereof, circuit traces extending outwardly along the common surface of the component or circuit to be connected to further circuit traces on said surface.

26. The interconnection of claim 23 wherein there are included at least two side-by-side rows of pads on the component and circuit.

27. The interconnection of claim 23 wherein there are at least four rows of pads in side-by-side relationship.

28. The interconnection of claim 23 wherein the said contacts and pads have tapered planar configurations to facilitate an internesting of contacts and pads.

29. The interconnection of claim 23 wherein the said pads are of a varying width, along the length thereof, to provide a generally consistent density for current flow from the ends toward the center of the pads.

30. In combination, a component and a circuit, or the like, adapted to be interconnected by a connector with the component and circuit having planar surfaces containing contact pads on given centers to be engaged by the contacts of the connector, such contacts being of a type deflected by closure of the component toward the circuit to provide contact wipe of the pads along a given axis to assure clean surfaces for the interconnection, the pads having a length sufficient to accommodate the length of the contact spring, including contact deflection and wipe, and a width appreciably less than the length to accommodate close pad spacing with the pad width varying from the ends toward the center to maintain a generally constant density of current flow from the pad ends toward the pad center while minimizing pad area to conserve metal plating and with the pad length of the component oriented generally transversely to the pad length of the circuit to optimize pad length of both circuit and component relative to the contact.

31. The combination of claim 30 wherein the said pads are tapered inwardly from the center thereof toward the ends.

32. The combination of claim 30 wherein the said pads are on the order of 0.075 to 0.083 inches in length and 0.020 inches in width at the center with pad centers on the order of between 0.040 and 0.050 inches or less.

33. The combination of claim 30 wherein at least two rows of pads have circuit traces connected to the ends thereof on a common surface with the pads.

34. The combination of claim 30 wherein there are included at least four rows of pads with the end of the pads connected to traces on a common surface thereof.

35. An electrical connector for use in interconnecting large numbers of planar conductive pads of a component to large numbers of planar conductive pads of a circuit on close centers to provide high density packaging including a thin flexible dielectric member with mounting means on centers compatible with the pads of the component and circuit, a contact held by the said mounting means in a position to interconnect each the component pad to the circuit pad, the contact having multiple resilient arms deflected by closure of the component toward the circuit, the pads of component and circuit effecting said deflection and with the contact arms having a geometry and characteristics to provide a balance of lateral forces in a plane parallel to the plane of the pads, component and circuit.

* * * * *